US006449808B1

(12) United States Patent
Zappa et al.

(10) Patent No.: US 6,449,808 B1
(45) Date of Patent: Sep. 17, 2002

(54) SECURITY SEAL WITH FLAG GRIP

(75) Inventors: Robert Zappa, Easton, PA (US); George Albert Lundberg, Jr., Pompton Plains, NJ (US)

(73) Assignee: E. J. Brooks Company, Livingston, NJ (US)

( * ) Notice: Subject to any disclaimer, the term of this patent is extended or adjusted under 35 U.S.C. 154(b) by 0 days.

(21) Appl. No.: 09/636,034

(22) Filed: Aug. 10, 2000

(51) Int. Cl.[7] ..... B65D 33/34; B65D 63/00

(52) U.S. Cl. ..... 24/16 PB; 24/17 AP; 24/30.5 P; 24/16 R; 292/321.323

(58) Field of Search ..... 24/16 PB, 17 AP, 24/30.5 P, 30.5 R, 3.13, 16 R; 292/322, 323, 321

(56) References Cited

U.S. PATENT DOCUMENTS 3,597,803 A * 8/1971 Nan Neil ..... 24/16 PB
3,600,027 A * 8/1971 Noland ..... 292/322
3,712,655 A * 1/1973 Fuehrer ..... 292/321
4,001,919 A 1/1977 Moberg et al.
4,059,300 A * 11/1977 Moberg et al. ..... 292/322
4,128,220 A * 12/1978 McNeel ..... 24/16 PB
4,174,554 A * 11/1979 Flantua ..... 24/30.5 P
4,501,049 A * 2/1985 Adamson ..... 24/30.5 P
4,501,354 A * 2/1985 Hoffman ..... 24/16 PB
4,506,415 A 3/1985 Swift
4,586,570 A * 5/1986 Swift ..... 24/16 PB
4,680,836 A * 7/1987 Wisecup ..... 24/16 PB
5,337,503 A 8/1994 Goby
5,524,945 A 6/1996 Georgopoulos et al.
6,062,521 A * 5/2000 Kelley et al. ..... 24/3.6

* cited by examiner

*Primary Examiner*—Victor Sakran
(74) *Attorney, Agent, or Firm*—Carella Byrne Bain Gilfillan Cecchi et al.; John G. Gilfillan, III; William Squire

(57) ABSTRACT

A flag seal comprises a thermoplastic socket, flag and shackle molded one piece. A metal locking tang element may optionally be molded into the socket. The shackle has a weakening groove. A finger gripping loop member extends about the flag both of which are flexible for receiving a finger. The gripping loop member provides enhanced finger gripping of the seal to pull on the seal to fracture the seal at the shackle weakening groove with an increased tensile load than otherwise possible.

13 Claims, 4 Drawing Sheets

SECURITY SEAL WITH FLAG GRIP

This invention relates to security seals, and more particularly, to molded plastic seals with elongated shackles extending from a flag and including a locking socket at the junction of the flag and shackle for receiving and locking the shackle thereto.

Thermoplastic molded security seals are in wide use. One type of such seal includes an elongated shackle, with or without teeth, extending from a flag, which is a flat sheet material element for receiving indicia such as a bar code, manufacturer identity, serial numbers and so on. These flags are some times referred to as tags. A locking socket extends from the flag at a region adjacent to the shackle junction. The socket has a cavity in which locking tangs are located for engaging the shackle to lock the shackle thereto when inserted in one direction, the tangs precluding withdrawal of the shackle in the opposite direction. Some locking sockets have metal inserts with the locking tangs formed therein. Other sockets are molded thermoplastic with the tangs molded one piece with the socket body, flag and shackle.

U.S. Pat. Nos. 4,506,415 ('415), 5,24,945 ('945) and 5,337,503 ('503) illustrate some of these type of flag seals, all incorporated by reference herein in their entirety. The '503 and '945 patents show the flags with bar code indicia printed thereon. In order to print the indicia on the flag, the flag is made relatively flat and smooth (It has some slight texture to permit inkjet printing) to provide a printing surface for the indicia. Since the flag is thermoplastic material it can be relatively slippery to grasp, the printing texture being insufficient to provide additional gripping friction. In these type of seals the shackle is passed through the locking socket and is pulled through as much as possible to tighten the loop formed by the shackle and locking socket about an article being sealed.

For example, such seals may be used to seal mail bags as illustrated in the '415 patent, FIG. 5. In FIG. 5, for example, the seal flag is shown extending in one direction and the free end of the shackle is extending generally in the opposite direction. To tighten the seal about the mouth of the bag, the shackle is manually grasped with one hand and the flag is grasped with the other hand.

When it is desired to open the seal, the flag is grasped and pulled. The shackle has one or more weakening regions formed by grooves so that when the flag is pulled, the seal is supposed to break at a weakened region. This is not always easy to do as the flag is slippery and difficult to provide a sufficiently high tensile load thereon in order to break the seal.

The present invention is a recognition of this problem and is directed to provide a solution. A seal according to the present invention comprises a locking socket including a body having a locking cavity and locking tangs in the cavity. A flag is secured to and extends from the socket in a first direction and a locking is shackle secured to at least one of the socket and flag and extends in a second direction opposite the first direction. A finger grip is attached to at least one of the flag and socket to enhance finger grasping of the seal.

In one aspect, the finger grip comprises a finger receiving loop member.

In a further aspect, the flag lies in a plane, the finger grip comprising a loop member having a normal acquiescent position coplanar with the flag. Preferably, the finger grip is a loop molded one piece thermoplastic integral with the seal.

In a further aspect, the finger grip comprises a loop member of circular cross section. Preferably, the flag has a periphery in the region extending from the socket, the loop member extending about the periphery coplanar with the flag. Preferably the finger grip is flexible to enable finger gripping.

In a further aspect, the flag is flexible so it can be flexed to grip the finger grip.

In a still further aspect, the finger grip is a grip enhancing projection. Preferably the projection is arranged so that it can be manually gripped and pulled on in the first direction while the shackle is manually gripped and pulled on in the second direction. Preferably the loop has a smooth surface with no protrusions thereon.

IN THE DRAWING

FIG. 1*a* is an isometric view of a flag seal according to an embodiment of the present invention;

FIG. 4 is a plan view of a blank used to form a shelf in the embodiment of FIG. 1;

Figure 1:
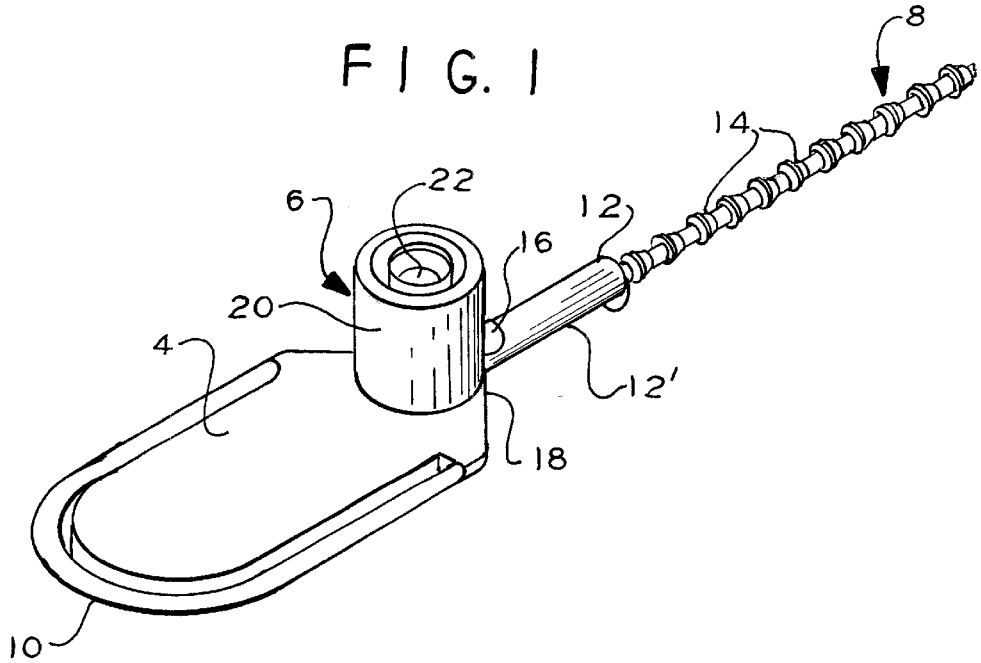
FIG. 1 is a fragmented more detailed isometric view of the flag seal of FIG. 1.
Figure 1A:
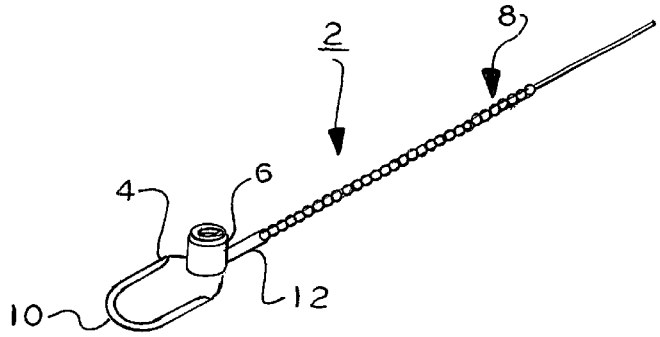

In FIG. 1*a* seal 2 comprises a flag 4, a locking socket 6, a toothed shackle 8 and a loop finger grip 10, all molded one piece integral from thermoplastic material. The shackle 8 is attached to the socket adjacent to end 18 of the flag 4 by a shank 12, the socket body and flag merging at end 18 at the shank 12. In FIG. 1, the shackle has a linear array of annular teeth 14 of conventional design. The shank 12 has a weakening groove 16 at the junction of the shank to the flag 4. The roots of the teeth 14 may be also of sufficient small diameter so as to provide a weakening region for fracturing the shackle in the presence of an induced high tensile load thereon.

Figure 7:
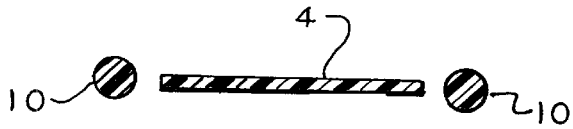
FIG. 7 is a sectional elevation view of the seal of FIG. 2 taken along lines 7—7.
Figure 3:
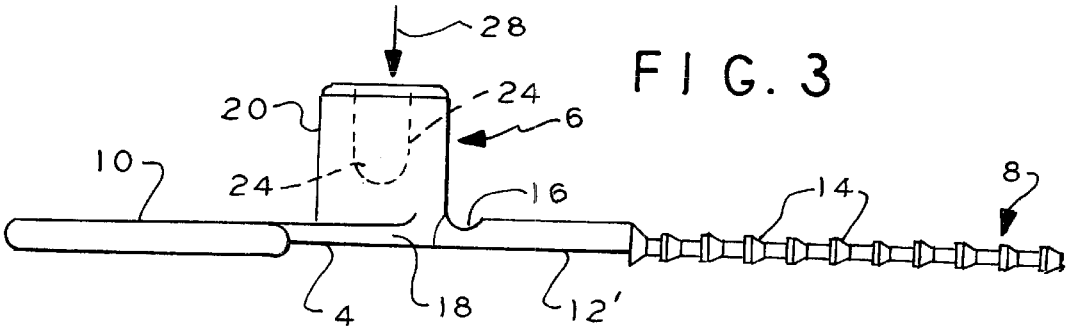
FIG. 3 is a side elevation view of the seal of FIG. 1.
Figure 4:
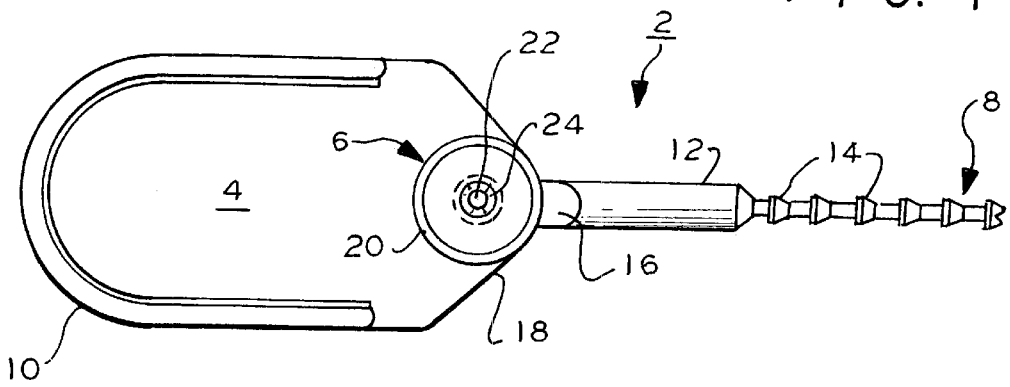
FIG. 4 is a top plan view of the seal of FIG. 1.
Figure 5:
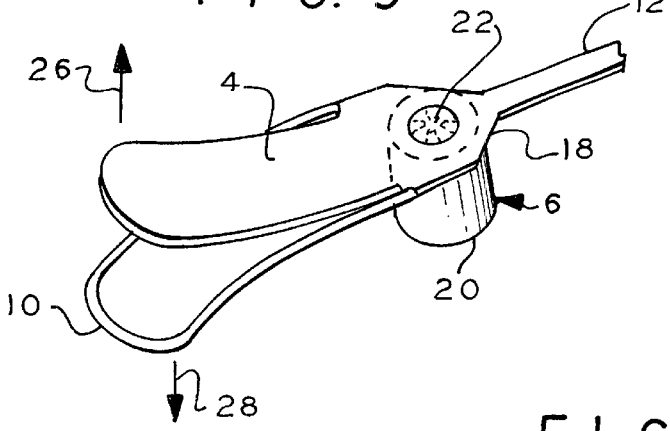
FIG. 5 is an isometric view of the seal of FIG. 2 in a configuration useful for explaining the principles of the present invention when the seal is in use.
Figure 6:
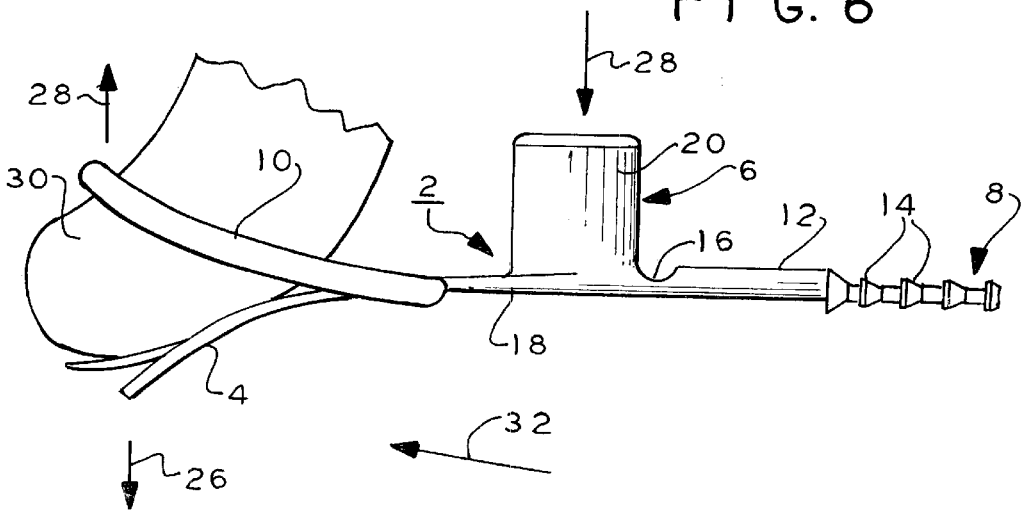
FIG. 6 is a side elevation view of the seal of FIG. 5.

The socket 6 comprises a body 20 having a cavity 22 in which locking tangs 24 are located. The tangs 24 are molded one piece with the socket and remaining elements forming the seal. The tangs 24, FIG. 3, are cantilevered in a tapered configuration and are radially resilient so that they permit the shackle 8 teeth 14 to ratchet therewith as the shackle is pulled through the tangs in the socket. cavity. The tangs 24 engage with and lock to the teeth 14 on the shackle 8. The flag 4 is relatively thin thermoplastic and is flexible and easily bent manually as shown in FIGS. 5 and 6. The flag is bent in direction 26 relative to the socket 6. The finger grip 10, FIG. 7 is of circular cross section to provide enhanced strength and is provided a smooth surface with no protrusions. The finger grip 10 is also flexible and can easily be bent manually in direction 28 as shown in FIGS. 5 and 6. The diameter of the finger grip 10 in this embodiment is larger than the thickness of the flag as shown in FIGS. 3 and 6.

Figure 2:
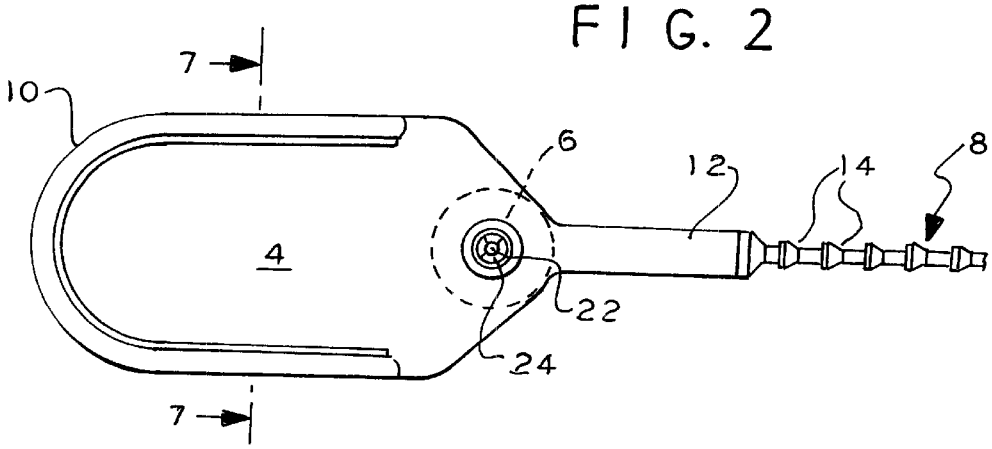
FIG. 2 is a fragmented bottom plan view of the seal of FIG. 1.

While the shackle in this embodiment has teeth 14, in other implementations, the shackle need not have teeth as illustrated in the aforementioned '945 patent incorporated by reference herein. The shackle while illustrated as circular in cross section may be flat or other shapes as known in this art and as illustrated in Pat. '945 which employs a metal tang insert in the locking socket cavity. In the present embodiment the locking tangs 24, FIG. 2, are molded plastic with the remainder of the seal but may also in the alternative comprise a separate metal element insert if desired.

In operation, the shackle 8 is inserted into the cavity 22 of the socket and wrapped about the neck of a sack or bag as shown in Pat. '945 and '415. The serrated form of the teeth 14 along the shackle length serve with the tangs 24 of the locking socket as a ratchet and pawl mechanism. The locking action permits insertion of the shackle, but not withdrawal in the opposite direction. The shackle 8 is inserted into the socket 6 in direction 28, FIGS. 3 and 6. The shackle is passed through the locking cavity 22 and is finger gripped to pull on the shackle and pull it about a bag to be sealed neck.

To remove the seal, it is desired to fracture the seal at the weakened groove 16 or other grooves such as the roots of the teeth 14. To do this, the index finger of an operator is inserted between the loop grip 10 and the flag 4, bending both in the process as shown in FIGS. 5 and 6. The index finger 30 tip, FIG. 6, slips between the loop grip 10 and flag bending both. The finger hooks onto the grip 10. The hand via the finger 30 can now positively pull on the flag in direction 32. This permits a relatively high tensile load to be placed on the shank at the groove 16 to fracture the shank.

Figure 8:
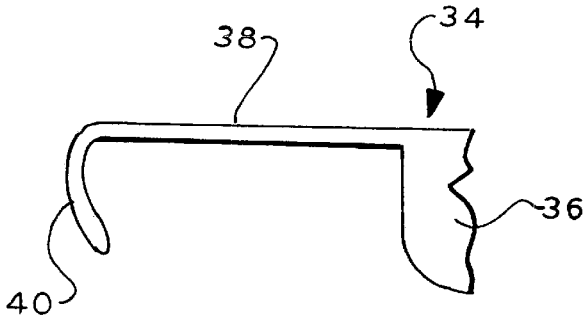
FIG. 8 is a fragmented side elevation view of a further embodiment of the present invention.

In the alternative, in FIG. 8, seal 34 has a locking socket 36, a flag 38 and a finger gripping projection 40. The projection 40 permits gripping the flag to assist in pulling on the flag and on the socket to fracture the shank or shackle.

Figure 9:
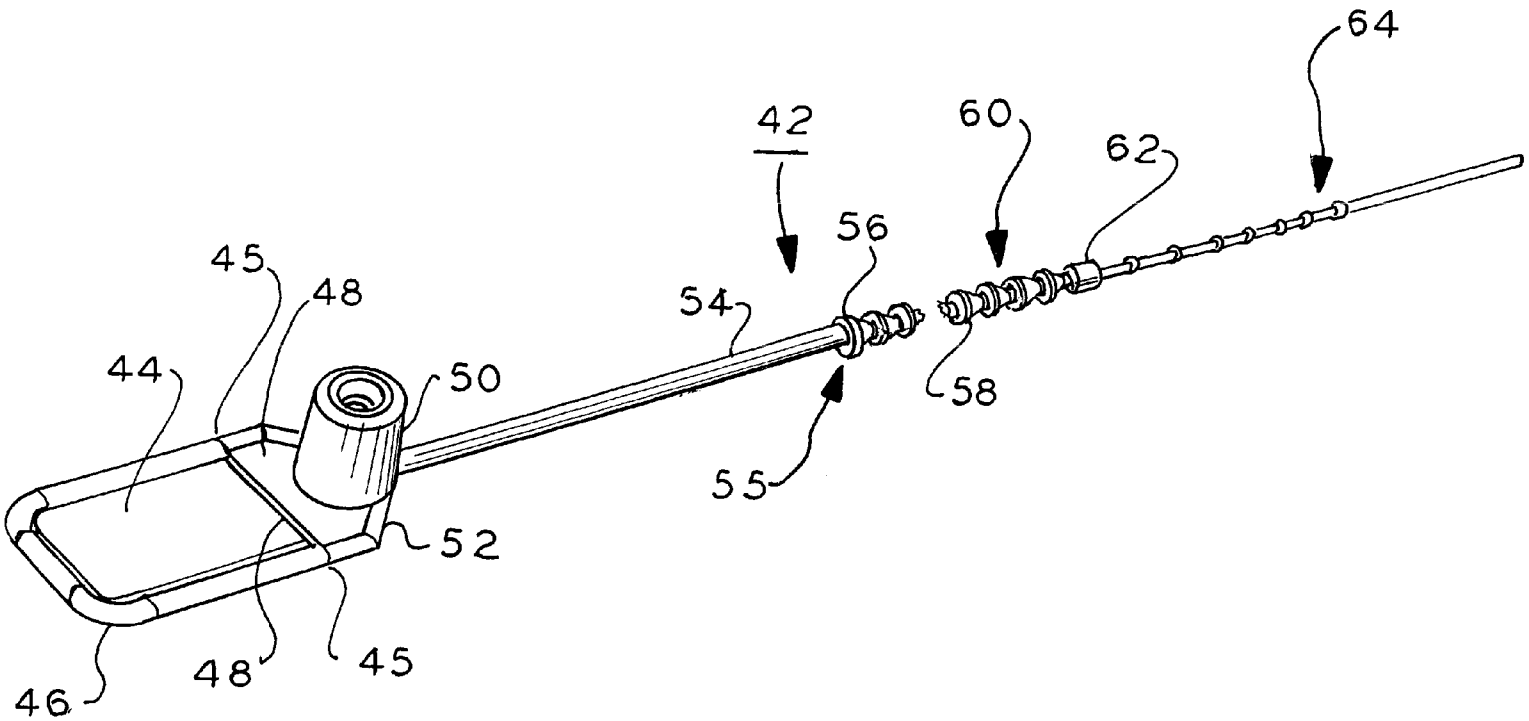
FIG. 9 is a fragmented isometric view of a further embodiment of a seal according to the present invention.

In FIG. 9, seal 42 comprises a flag 44 and a U-shaped grip 46 molded one piece of thermoplastic material. The grip 46 is attached to the flag 44 at grip ends 45, the remainder of the grip being separate from the flag 44. The flag 44 has a transverse groove 48 which forms a living hinge to permit the flag 44 to more easily bend relative to the flag portion 48. The locking socket 50 extends from the flag portion 48 and is of the same construction as the socket 6 of the embodiment of FIG. 1. The flag portion 48 has a peripheral rib 52 on each side of the portion 48. The rib 52 is circular in cross section and is a continuation of the configuration of the grip 46 which is also circular in cross section. The rib 52 provides additional strength to the flag 44.

Shank 54 of shackle 55 is circular cylindrical in cross section as compared to the shank 12, FIGS. 1 and 3, which has a flattened side 12'. Also, the shank 54 is substantially longer than shank 12 to accommodate mating structures to which the seal is to be attached. A stop lug 56 is at the interface of the shank 54 and locking tangs 58 on the shank extended portion 60, only a portion of which is shown, the portion 60 being fragmented to simplify illustration. The stop lug prevents the shank 54 from being pulled through the locking socket locking tangs (not shown). A further stop lug 62 is at the end of the tang portion 60 distal the lug 56. The lug 62 is a right circular cylinder in this embodiment and has right angle surfaces at its ends to preclude the shank portion 60 from being inserted incorrectly in the wrong direction in the locking socket 50. The locking tangs (not shown) in the locking socket 50 abut the lug 62 when inserted incorrectly and stop it from locking engaging those tangs. This ensures the shackle is correctly locked to the socket 50 at all times.

The tip 64 of the shank 54 has annular ribs 66 to facilitate manual gripping the tip for pulling the shank through the socket 50.

The grip 46 is gripped with the index finger in use to manually sever the shank 54 at a weakened region (not shown) comprising a groove or recess at the socket 50. The flag 44 is bent at groove 48 to facilitate insertion of the finger between the flag and grip to engage the grip.

It will occur to one of ordinary skill that modifications may be made to the disclosed embodiments without departing from the scope of the invention as defined in the appended claims. The disclosed embodiments are given by way of illustration and not limitation. For example, the grip member attached to the flag may take the form of projections, bumps or other friction enhancing devices on one side of the flag to permit embossing or other printing on the opposite side of the flag. The projections, bumps and so on enhance the friction between the fingers of a user and the flag. However, the loop member and projection embodiments described in respective FIGS. 1 and 8 provide a positive non-slip grip on the flag as compared to bumps and the like, and are preferred. While the finger grip is shown is attached to the flag, it could also extend from the socket body or both as a loop or other finger gripping projection to provide enhanced gripping of the seal and pulling force on the seal to fracture the seal. The weakening groove may be part of the shackle teeth or separately provided on the shackle shank as shown.

What is claimed is:

1. A seal comprising:

a locking socket including a body having a locking cavity and locking tangs in the cavity;

a flag secured to and extending from the socket in a first direction;

a locking shackle secured to at least one of the flag and socket and extending in a second direction opposite the first direction; and a finger grip attached to at least one of the flag and socket and extending therefrom in the first direction to enhance the manual grasping and pulling force on the seal.

2. The seal of claim 1 wherein the finger grip comprises a finger receiving loop member.

3. The seal of claim 1 wherein the flag lies in a plane, the finger grip comprising a loop member having a normal acquiescent position coplanar with the flag.

4. The seal of claim 1 wherein the finger grip is a loop molded one piece thermoplastic integral with the seal.

5. The seal of claim 4 wherein the loop has a smooth surface with no protrusions thereon.

6. The seal of claim 1 wherein the finger grip comprises a loop member of circular cross section.

7. The seal of claim 6 wherein the flag has a periphery in the region extending from the socket, the loop member extending about the periphery coplanar with the flag.

8. The seal of claim 1 wherein the finger grip is flexible to enable finger gripping.

9. The seal of claim 1 wherein the flag is flexible so it can be flexed to grip the finger grip.

10. The seal of claim 1 wherein the finger grip is a grip enhancing projection.

11. The seal of claim 10 wherein the projection is arranged so that it can be manually gripped and pulled on in the first direction while the shackle is manually gripped and pulled on in the second direction.

12. A seal comprising:

a locking socket including a body having a locking cavity and locking tangs in the cavity;

a flag secured to and extending from the socket in a first direction;

a locking shackle secured to at least one of the flag and socket and extending in a second direction opposite the first direction, the locking shackle including tapered teeth for engaging the socket locking tangs; and a stop lug on the shackle for permitting insertion of the shackle into the locking socket in only one direction.

13. A seal comprising:

a locking socket including a body having a locking cavity and locking tangs in the cavity;

a flag secured to and extending from the socket in a first direction;

a locking shackle secured to at least one of the flag and socket and extending in a second direction opposite the first direction; and a finger grip attached to at least one of the flag and socket to enhance the manual grasping and pulling force on the seal;

the finger grip comprising a loop member of circular cross section and the flag has a periphery in the region extending from the socket, the loop member extending about the periphery coplanar with the flag.

* * * * *